US005467958A

United States Patent [19]

Selvaggio

[11] Patent Number: 5,467,958

[45] Date of Patent: Nov. 21, 1995

[54] ADJUSTABLE DOCUMENT HOLDER STAND

[76] Inventor: John J. Selvaggio, 5695 Cherokee Rd., Lyndhurst, Ohio 44124

[21] Appl. No.: 332,476

[22] Filed: Oct. 31, 1994

Related U.S. Application Data

[63] Continuation of Ser. No. 85,684, Jul. 2, 1993, abandoned, which is a continuation-in-part of Ser. No. 812,041, Feb. 10, 1992, abandoned.

[51] Int. Cl.[6] ..... A47B 97/04

[52] U.S. Cl. ..... 248/449; 248/452

[58] Field of Search ..... 248/411, 448, 248/449, 451, 452, 453, 442.2, 460, 447

[56] References Cited

U.S. PATENT DOCUMENTS

| | | | |
|---|---|---|---|
| 575,729 | 1/1897 | Palmer | 248/448 |
| 1,994,225 | 3/1935 | Lurcott | 248/449 |
| 2,550,550 | 4/1951 | Goodstein | 248/448 |
| 2,882,641 | 4/1959 | Young | 248/448 |
| 2,912,203 | 11/1959 | Townsend | 248/448 |
| 3,733,689 | 5/1973 | Armitage | 248/448 |
| 4,042,203 | 8/1977 | Waekentin | 248/449 |
| 4,360,183 | 11/1982 | Biasini | 248/451 |
| 4,856,749 | 8/1989 | Habermann | 248/448 |
| 5,037,057 | 8/1991 | Andrews | 248/448 X |
| 5,074,512 | 12/1991 | Gianforcard, II et al. | 248/442.2 |

*Primary Examiner*—Ramon O. Ramirez
*Assistant Examiner*—Korie H. Chan

[57] ABSTRACT

An adjustable multipurpose document holder stand that is capable of holding small and large documents, drawings, blueprints, or rigid displays. The holder having three elongated arm sections pivotally connected together via hinges. The hinges allowing the two end arms to extend outward horizontally to approximately forty-eight inches, enabling it to hold larger sized documents. Each of the three elongated sections having a clamp spanning the length of the elongated sections to which it is attached for holding documents such as computer printouts. A telescoping elongated tubular structure having a base at one end while the opposite end is secured to the middle arm section for height adjustability. A clip extending outwardly from the middle arm section for cooperating with an adjustable ledge disposed on the telescoping elongated tubular structure for holding rigid displays.

1 Claim, 5 Drawing Sheets

ADJUSTABLE DOCUMENT HOLDER STAND

This application is a continuation of application Ser. No. 08/085,684, filed Jul. 7, 1993, now abandoned, and which is a continuation-in-part of application Ser. No. 07/812,041 filed Feb. 10, 1992, now abandoned.

BACKGROUND OF THE INVENTION

The present invention relates to a multipurpose document holder stand, that is capable of being used for a multiple of applications. It is an improved large document holder that is capable of holding wide documents up to 48 inches, long computer printout forms, and also rigid displays.

FIELD OF THE INVENTION

In the past architects and/or engineers have had the problem of how to reliably and ergonomically hold large blueprints while sitting at a computer workstation. The invention solves a problem by being capable of holding common "E" sized blueprints that are equal to 48" wide. The problem also existed in various office situations of conveniently holding computer printout forms while sitting at a computer workstation. Also, it is a practical novelty to utilize a multipurpose unit not only capable of being used as a document holder, but also as an easel in order to hold rigid displays. Normally, the documents being viewed are of large and varying width and length sizes and shapes not readily adaptable to conventional document holders or easels. In arriving at the present invention, it was noted that no easy solution existed for displaying, suspending or hanging documents or rigid displays of various sizes and shapes from one multipurpose adjustable stand.

DESCRIPTION OF THE PRIOR ART

In the past there have been other document holders, most of which are for small letter size documents and (or) a type which clamps to a desk. Nothing has been seen of a multipurpose document holder stand similar to this invention. Typical references are the following:

U.S. Pat. No. 575,729, Palmer, discloses an invention intended for the desks of what were known as "music pulpits." Its object was to provide a desk that could be extended to a width sufficient for the music-sheets of two performers playing together.

U.S. Pat. No. 1,994,225, Lurcott, discloses a painter's easel to support a canvas.

U.S. Pat. No. 2,550,550, Goodstein, shows a collapsible artist's easel for supporting a framed canvas and paint box, in position for use.

U.S. Pat. No. 2,882,641, Young, discloses an invention relating to a support for postioning blueprints of shop drawings at eyelevel examination for shop workmen, by laying the blueprint upon it.

U.S. Pat. No. 2,912,203, Townsend, shows improvements in an adjustable center bar for artist's easels and more specifically relates to improved adjusting means for accommodating canvases or pictures of different sizes and for selectively positioning the same in different vertical adjusted positions upon the easel.

U.S. Pat. No. 4,360,183, Biasini, discloses a device adapted to be mounted to a conventional music stand to hold sheet music to the back panel of the stand.

U.S. Pat. No. 4,856,749, Habermann, discloses an expandable easel which can hold canvases and other work pieces having a wide variety of sizes and shapes in a number of different positions.

U.S. Pat. No. 5,037,057, Andrews, discloses a collapsible swing-out extendible music stand capable of tilting and holding multiple sheets or books simultaneously on a vertical shaft and foldable tripod base.

U.S. Pat. No. 5,074,512, Gianforcaro, II et al, discloses a computer monitor drawing-exhibit sheet-mounting and adjusting assembly adapted for viewing the drawing exhibit while drawing with a computer drawing mouse or digital tablet-cusor, comprising: an adjustable vise means for adjustably mounting by clamping on a computer monitor.

The present invention is new and unique and was not known or used by others in this country, before the invention. Nothing similar has been in public use or on sale in this or any other foreign country. The subject matter is different from what has been used or described before and was unobvious to a person having ordinary skill in the area of technology related to the invention. Up to now, the art contained no indication of a desirability of providing a multipurpose large document holder stand.

SUMMARY OF THE INVENTION

It was the primary intent, (but not the only intent), of the inventor to develop a document holder capable of being used to hold engineering drawings and blueprints, as an aid to view them in a more ergonomic and beneficial manner while sitting at a CAD (Computer Aided Drafting) workstation. It is capable of holding documents straight and erect, and can be properly adjusted to the viewer's eye level for easier and more comfortable viewing. The "Adjustable Document Holder Stand" can be used in any situation, requiring a document holder capable of holding any small or large document up to forty-eight inches, or long continuous computer printer forms, it can aid to make it easier and more comfortable for someone viewing computer spreadsheets, for example. The invention holds the document via paper clamps that are attached to three sixteen inch elongated sections, that can adjust to hold different sizes of documents.

This invention can also hold more rigid material in a straight and erect position, such as canvas, display boards or charts, in another manner other than the traditional tripod angular manner. There is a horizontally positioned adjustable ledge located near the center of the elongated telescoping section, which is capable of propping up the material, somewhat like an easel. The location of the ledge on the elongated telescoping section may be altered or removed by loosening the wing nuts. There is an upper clip at the top and center portion of the stand to hold the material more secure. Also, when the top elongated sections are lowered they help give the rigid material more support behind it.

The invention may also contain an optional fluorescent light fixture, which will give the document more lighting the light fixture is located at the top and on the center of the stand. Also, casters may be an option for easier mobility, if desired. Other options may be added at the users discretion.

DESCRIPTION OF THE PREFERRED EMBODIMENT

Figure 1:
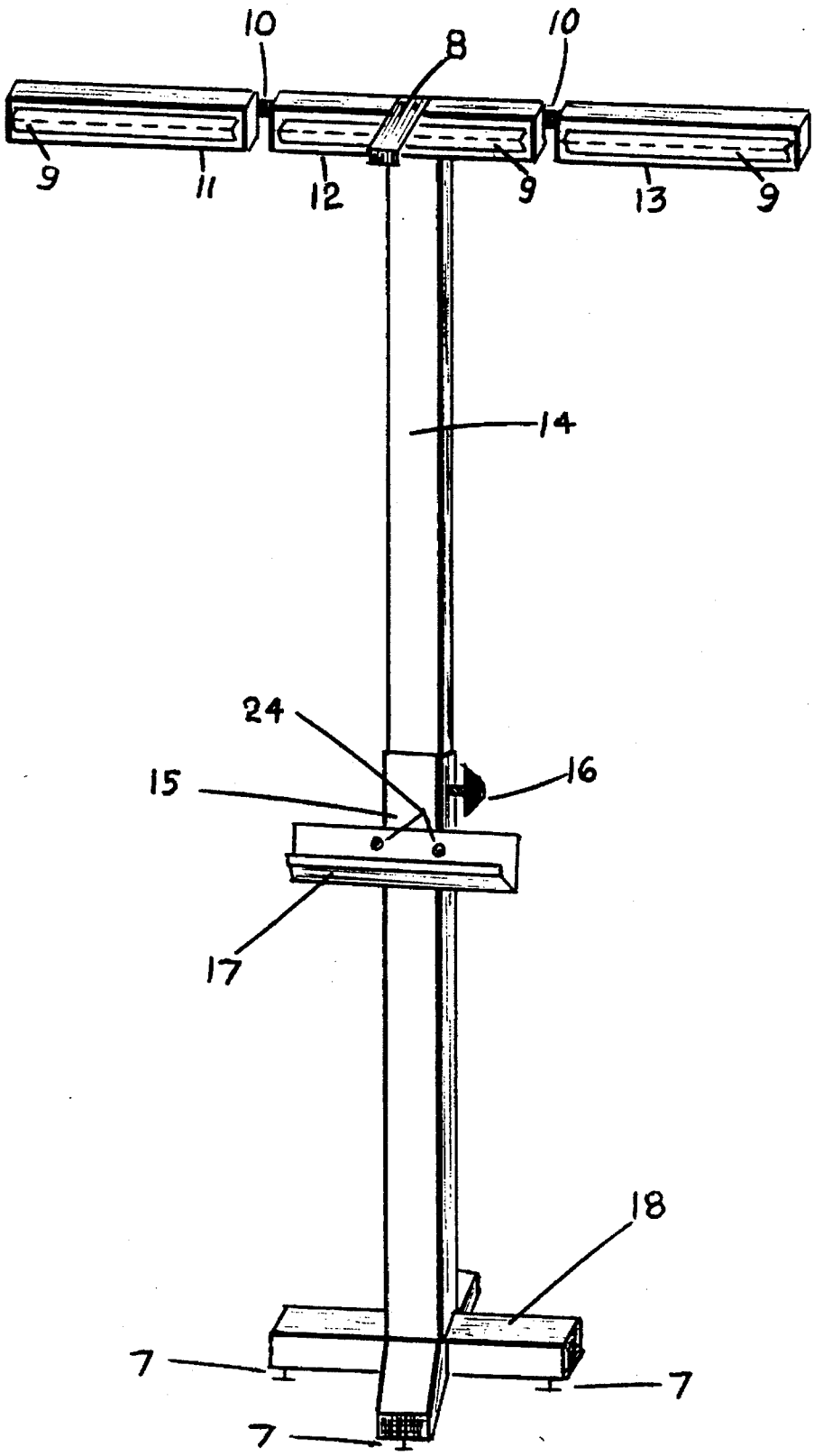
FIG. 1 is an isometric view of the "Adjustable Document Holder Stand" fully extended.

Referring first to FIG. 1 is the "Adjustable Document Holder Stand" fully extended. There are three, approximately 16 inch elongated arm sections. The middle elongated arm section 12 connects the left elongated arm section 11 and the right elongated arm section 13 by two hinges 10, which are metal brackets approximately ½A inch by 3 inches in dimension. On the elongated arm sections are paper clamps 9 which are screwed into each of the three elongated arm sections 11, 12, 13. The paper clamps 9 are approximately the same length as the three elongated arm sections 11, 12, 13. The paper clamps 9 are used to clip to the document that is being held. The middle elongated arm section 12 is connected directly in the center, in a "T" connection, either by a weld or a connector, to a 1 inch upper vertical elongated tubular section approximately forty inches long 14, which is inserted in a telescopic manner, into a slightly larger 1¼ inch lower vertical elongated tubular section 15, which is approximately 36 inches long. The combination of these two vertical elongated tubular sections constitute a telescopic vertical elongated tubular structure. A cross-like shaped elongated section base 18 with four adjustable leveling glides 7 keeps the stand stable in an upright position. An adjustment knob with a threaded stud 16 screws into a tapped hole, at the upper portion of the 1¼ inch lower vertical elongated tubular telescopic section 15. The adjustment knob 16 is loosened or tightened to adjust the stand to the proper height. An angular ledge 17 with screws 24 clamps around the lower vertical elongated tubular section 15. The ledge 17 is used to hold more rigid material, for example, a display board. There is an upper clip 8 on top, approximately ½ inch wide by 2 inches long, which is screwed directly in the center of the middle elongated arm section 12, in order to hold the rigid material securely, by means of the upper clip 8 and the ledge 17, after the upper vertical tubular section 14 is lowered within in the verticle telescopic elongated tubular structure.

Figure 2:
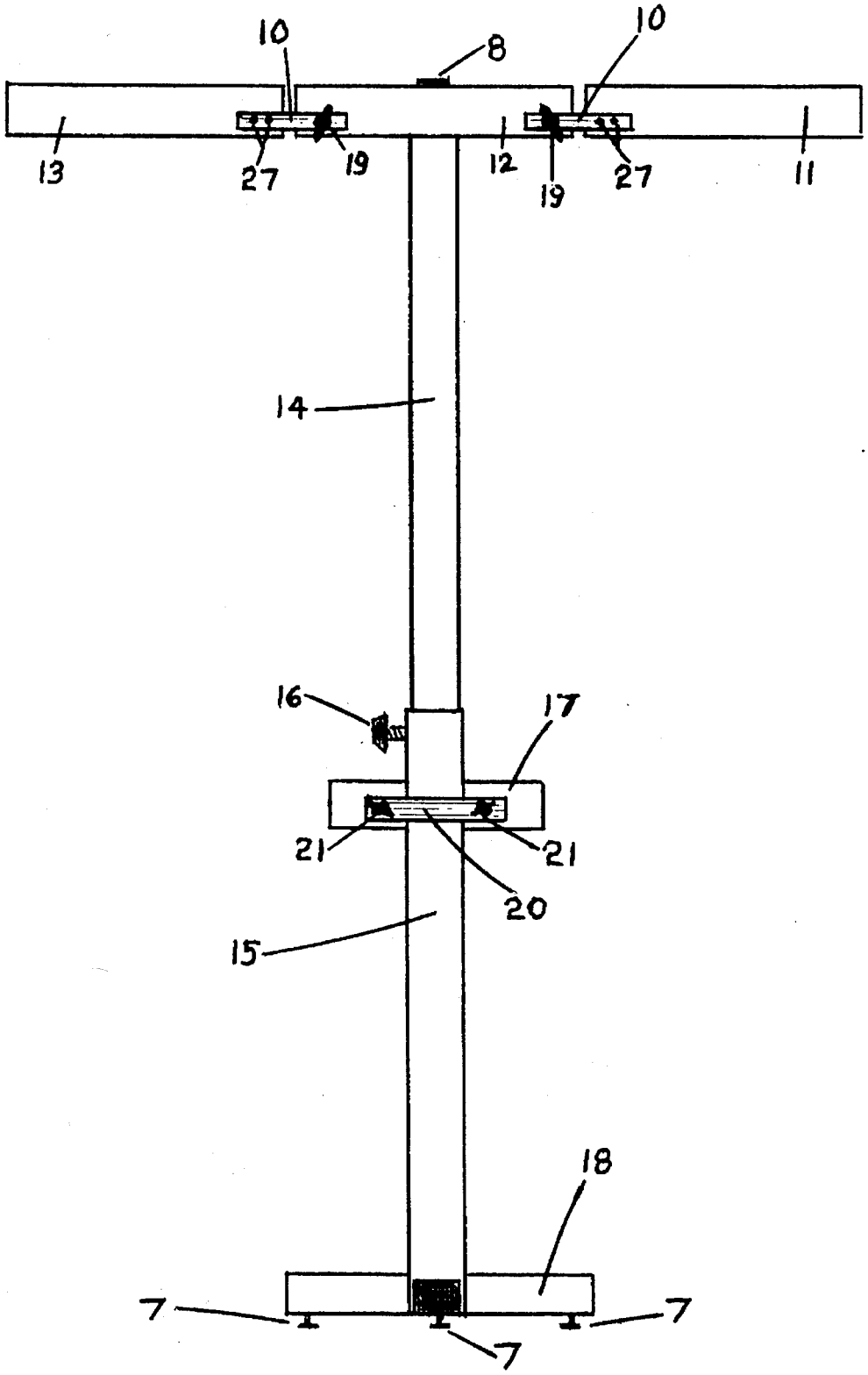
FIG. 2 is a rear view of the stand fully extended.
Figure 8:
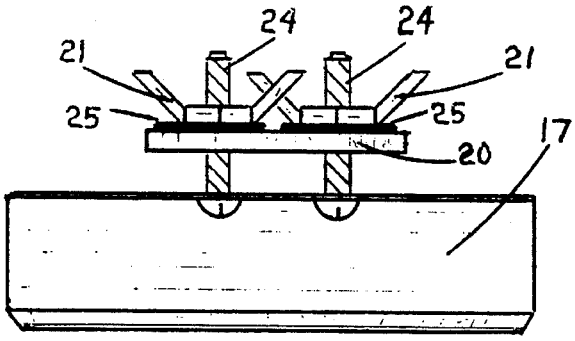
FIG. 8 shows a top view of the ledge used to hold rigid displays. It shows how it is designed enabling it's height to be vertically adjusted along the elongated telescopic structure.
Figure 9:
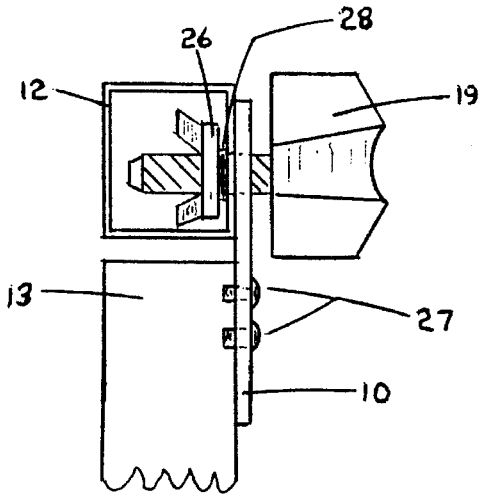
FIG. 9 shows a side view detailing how the adjustment knobs function when loosening or tightening the knob, in order to raise or lower the elongated sections with fixed paper clamps.

The rear view of FIG. 2 shows the hinge 10 connecting the elongated arm sections 11, 12, 13. Two studs 27 keep the hinges 10 fixed to the elongated arm sections 11, 13, and adjustment knobs 19 tighten into the middle elongated arm section 12 after the end elongated arm sections 11, 13 are raised or lowered to the desired level. FIG. 9 shows a side view of how the assembly would look after one of the elongated am sections 11, 13 is lowered. Wing nuts 26 and lock washers 28 fasten to the stud of the adjustment knob 19 in order to firmly tighten the elongated arm sections 11, 13 in position. FIG. 8 shows the assembly of the ledge 17 that holds the rigid material display. Approximately 2 inch screws 24 protrude from the ledge 17 and connect to a bracket 20 and fits around the lower portion of the lower vertical elongated telescoping tube section 15. The wing nuts 21 and lock washers 25 are tightened to remove or properly adjust the position of the ledge 17. A rear view of the ledge is also seen in FIG. 2.

Figure 3:
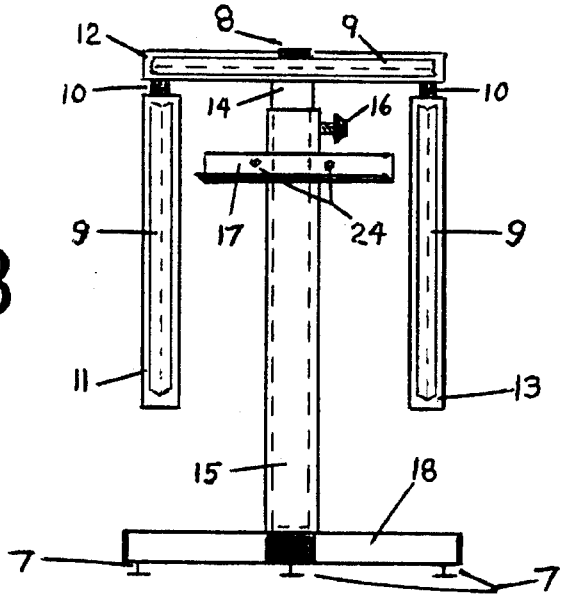
FIG. 3 is a front view of the stand fully compressed.

FIG. 3 shows the "Adjustable Document Holder Stand" after it is fully compressed. The two end elongated arm sections 11, 13 are lowered and the vertical elongated telescoping section 14 is fully lowered.

Figure 4:
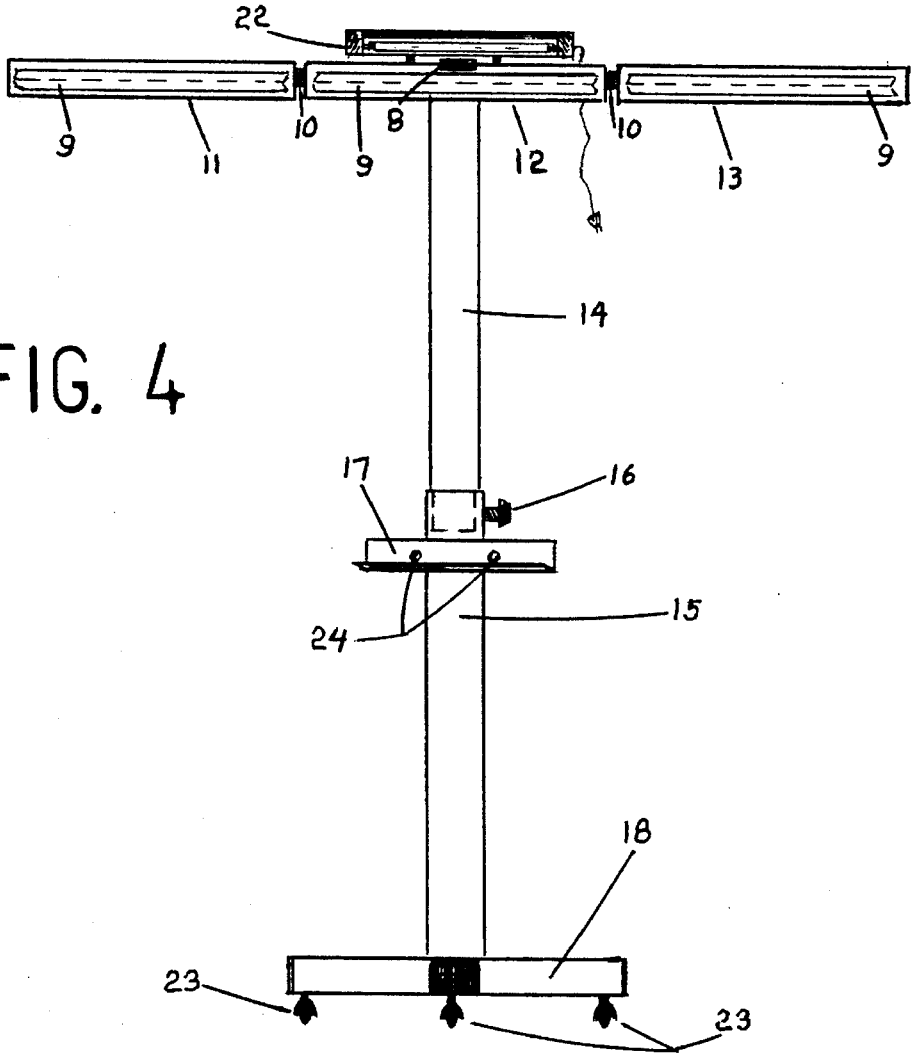
FIG. 4 is a front view of the stand fully extended and also showing an optional fluorescent light fixture and optional casters.

FIG. 4 shows the "Adjustable Document Holder Stand" when it is fully extended and shows it with an optional light fixture 22 and optional casters 23.

Figure 5:
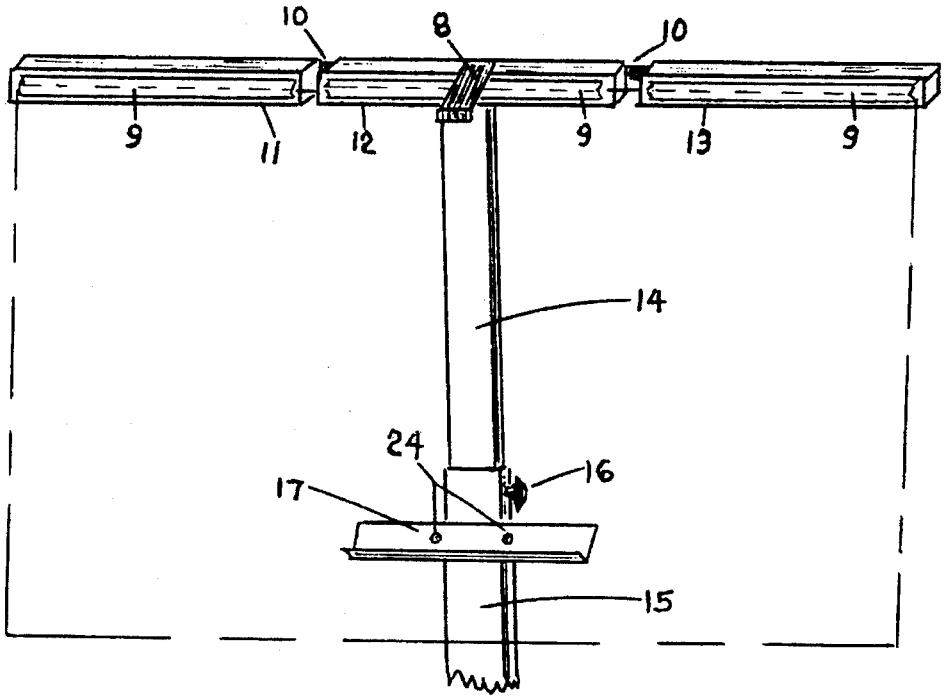
FIG. 5 shows how the "Adjustable Document Holder Stand" would clamp a large document that is about forty-eight inches long.

FIG. 5 illustrates how the "Adjustable Document Holder Stand" would hold a large paper document approximately 48 inches long.

Figure 6:
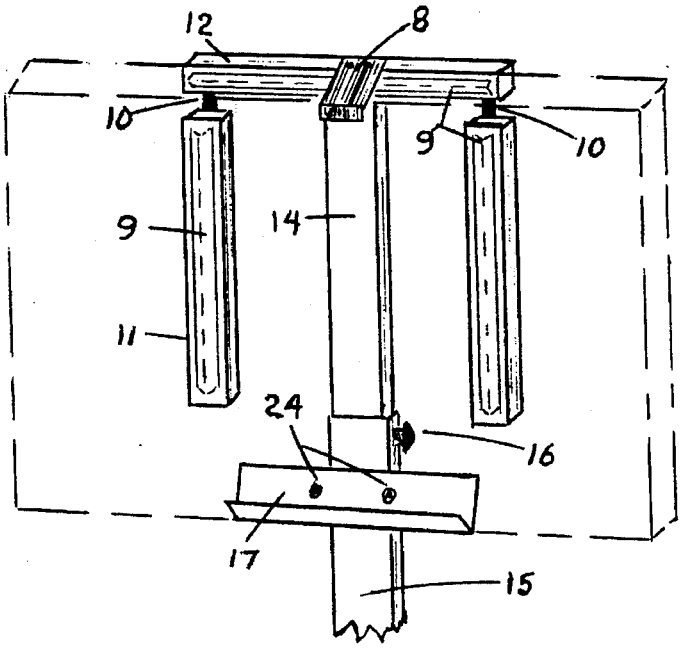
FIG. 6 shows how the "Adjustable Document Holder Stand" would hold a more rigid display on the ledge being used like an easel.

FIG. 6 shows the "Adjustable Document Holder Stand" holding a rigid material display. The two end elongated arm sections 11, 13 are lowered in order to give the display more support behind it. The ledge 17 and the upper clip 8 also keep the display secure, after the upper elongated telescoping section 14 is lowered, into the lower vertical elongated telescoping tube section 15.

Figure 7:
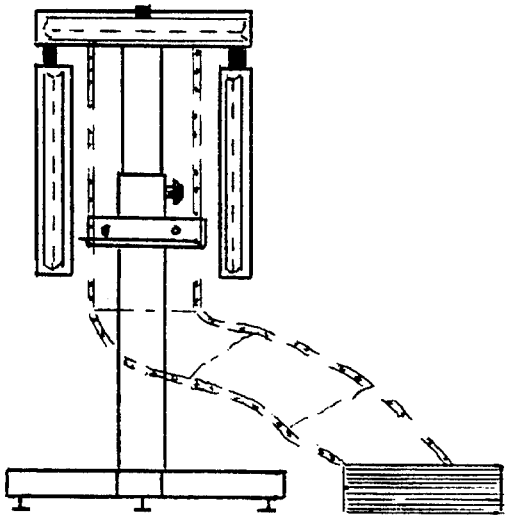
FIG. 7 shows how the "Adjustable Document Holder Stand" would hold long documents, for example, continuous computer forms. The stand's height can adjust vertically higher or lower.

FIG. 7 shows the "Adjustable Document Holder Stand" holding continuous computer printer forms. It can either be raised or lowered.

I claim:

1. A multipurpose adjustable document holder stand comprising:

three elongated sections which includes one middle elongated section, a left elongated section, a right elongated section, each of said three elongated section having generally the same length; three approximately same length paper clamps, each of said clamps fixed to a respective one of said elongated sections, for clamping various size documents; two hinges connect pivotally said three elongated sections, to allow the raising and lowering of said left and right sections relative to the middle section; an elongated tubular telescoping structure for height adjustment whereby, said elongated tubular telescoping structure consists of one upper inner elongated tubular section and one lower outer elongated tubular section; whereby, one end of said upper tubular section is inserted into said a slightly larger dimensioned lower outer elongated tubular section, the opposite end of said upper tubular section is secured to said middle elongated section; a cross shaped tubular base secured to a bottom portion of said lower outer elongated tubular section; an adjustable ledge clamped to said elongated tubular telescoping structure, for adjusting the height and supporting various sized rigid displays; and an upper clip located at the top and center of said middle elongated section, for securing the top portion of a rigid display when said display is supported on said adjustable ledge.

* * * * *